United States Patent [19]

Holden et al.

[11] Patent Number: 4,740,171

[45] Date of Patent: Apr. 26, 1988

[54] VACUUM CLEANER HOSE AND TERMINAL CONNECTOR THEREFOR

[75] Inventors: Homer N. Holden, Sylva; Roger D. Meadows, Waynesville, both of N.C.

[73] Assignee: Dayco Products, Inc., Dayton, Ohio

[21] Appl. No.: 17,663

[22] Filed: Feb. 24, 1987

[51] Int. Cl.[4] ..... H01R 4/24

[52] U.S. Cl. ..... 439/191; 439/396; 439/400; 439/410

[58] Field of Search ..... 439/191, 192, 395, 396, 439/397, 404, 405, 409, 410, 400; 29/865, 866

[56] References Cited

U.S. PATENT DOCUMENTS

| | | | |
|---|---|---|---|
| 3,145,261 | 8/1964 | Forney, Jr. | 439/400 |
| 3,634,605 | 7/1972 | Dola | 439/397 |
| 3,879,099 | 4/1975 | Shaffer | 439/397 |
| 3,928,715 | 12/1975 | Holden | 174/47 |
| 3,950,065 | 4/1976 | Renn | 439/400 |
| 4,191,442 | 3/1980 | Caveney et al. | 439/400 |
| 4,324,450 | 4/1982 | Weisenburger et al. | 439/400 |
| 4,382,650 | 5/1983 | Herrmann, Jr. | 439/395 |
| 4,456,321 | 6/1984 | Jones et al. | 439/395 |

*Primary Examiner*—John McQuade

*Attorney, Agent, or Firm*—Joseph V. Tassone

[57] ABSTRACT

A vacuum cleaner hose construction, terminal connector therefor and methods of making the same are provided, the vacuum cleaner hose construction comprising an elongated vacuum hose having an electrical conductor extending therealong and being provided with an end portion, and an electrical connector carried by the hose and being fixed to the end portion, the connector having a knife-like portion provided with opposed edges defining sides of a slot therein that has an open end and a closed end. The end portion is disposed in the slot of the connector and is wedged between the opposed edges thereof for providing electrical connection therebetween. The connector has a holding unit carried thereby and having a part thereof disposed adjacent the conductor to hold the conductor in the slot by trapping the conductor between that part and the closed end of the slot.

3 Claims, 4 Drawing Sheets

VACUUM CLEANER HOSE AND TERMINAL CONNECTOR THEREFOR

BACKGROUND OF THE INVENTION

1. Field of the Invention

This invention relates to a new vacuum cleaner hose construction and to a new method of making a vacuum cleaner hose construction as well as to a new terminal connector for a vacuum cleaner hose construction and a new method of making a terminal connector for a vacuum cleaner hose construction.

2. Prior Art Statement

It is known to provide a vacuum cleaner hose construction that comprises an elongated vacuum hose having an electrical conductor extending therealong and being provided with an end portion, and an electrical connector carried by the hose and being fixed to the end portion, the connector having a knife-like portion provided with opposed edges defining sides of a slot therein that has an open end and a closed end, the end portion being disposed in the slot of the connector and being wedged between the opposed edges thereof for providing electrical connection therebetween. For example, see the U.S. PAT. No. 3,928,715 to Holden.

SUMMARY OF THE INVENTION

It is one feature of this invention to provide a new vacuum cleaner hose construction wherein unique means are provided for holding an end portion of an electrical conductor of the vacuum hose in a slot of a terminal connector that is fixed to that end portion of the conductor.

In particular, it was found according to the teachings of this invention that the terminal connector can have holding means carried thereby and have a part thereof disposed adjacent the conductor to hold that conductor in the slot of the connector by trapping the conductor between that part and a closed end of the slot of the connector.

For example, one embodiment of this invention provides a vacuum cleaner hose construction that comprises an elongated vacuum hose having an electrical conductor extending therealong and being provided with an end portion, and an electrical connector carried by the hose and being fixed to the end portion, the connector having a knife-like portion provided with opposed edges defining sides of a slot therein that has an open end and a closed end, the end portion being disposed in the slot of the connector and being wedged between the opposed edges thereof for providing electrical connection therebetween. The connector has holding means carried thereby and has a part thereof disposed adjacent the conductor to hold the conductor in the slot by trapping the conductor between that part and the closed end of the slot.

Accordingly, it is an object of this invention to provide a new vacuum cleaner hose construction having one or more of the novel features of this invention as set forth above or hereinafter shown or described.

Another object of this invention is to provide a new method of making a vacuum cleaner hose construction, the method of this invention having one or more of the novel features of this invention as set forth above or hereinafter shown or described.

Another object of this invention is to provide a new terminal connector for a vacuum cleaner hose, the terminal connector of this invention having one or more of the novel features of this invention as set forth above or hereinafter shown or described.

Another object of this invention is to provide a new method of making a terminal connector for a vacuum hose, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 2:
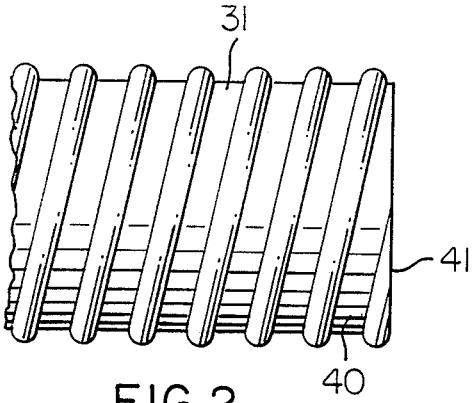
FIG. 2 is a fragmentary reduced view of an end of a vacuum hose being utilized to form the vacuum cleaner hose construction of FIG. 1.
Figure 3:
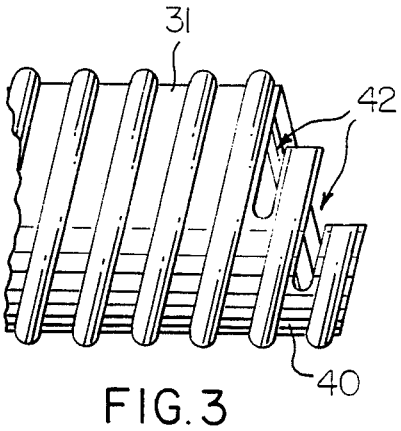
FIG. 3 is a view similar to FIG. 2 and illustrates how the end of the vacuum hose is cut before the terminal connectors of this invention are attached thereto to form the vacuum cleaner hose construction of FIG. 1.

While the various features of this invention are hereinafter illustrated and described as being particularly adapted to provide a new terminal connector for a vacuum cleaner hose, it is to be understood that the various features of this invention can be utilized singly or in various combinations thereof to provide a new terminal conductor for other structure, as desired.

Therefore, this invention is not to be limited to only the embodiments illustrated in the drawings, because the drawings are merely utilized to illustrate one of the wide variety of uses of this invention.

Figure 1:
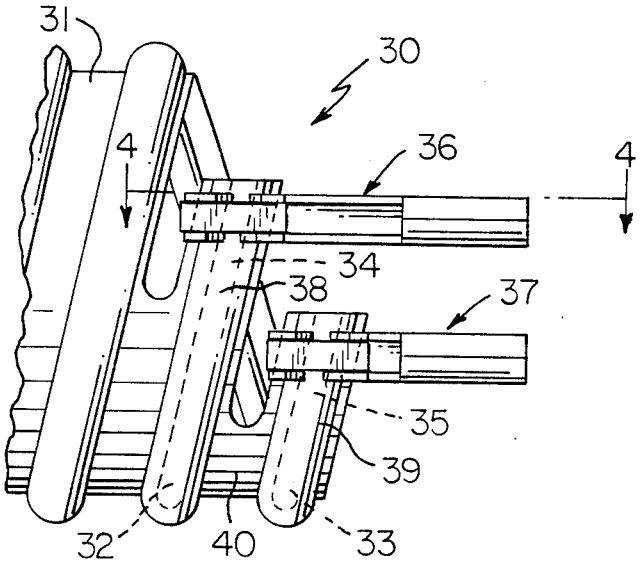
FIG. 1 is a fragmentary view of the new vacuum cleaner hose construction of this invention.

Referring now to FIG. 1, the new vacuum cleaner hose construction of this invention is generally indicated by the reference numeral 30 and comprises an elongated vacuum hose 31 having electrical conductors 32 and 33 extending therealong and being respectively provided with end portions 34 and 35 and a plurality of electrical terminal connectors 36 and 37 respectively fixed to the end portions 34 and 35 in a manner hereinafter set forth, the vacuum hose 31 being formed of any suitable material, such as polymeric material, and having the conductors 32 and 33 helically disposed along the same and being embedded therein in a conventional manner so that the conductors 32 and 33 are surrounded by insulation means 38 and 39 which must be severed at the end portions 34 and 35 thereof by the terminal connectors 36 and 37 so as to provide electrical connection between the conductors 32 and 33 and the connectors 36 and 37 for a purpose that is conventional in the art and is fully set forth in the aforementioned U.S. Pat. No. 3,928,715 to Holden, whereby this patent is being incorporated into this disclosure by this reference thereto.

Therefore, since it is well known to complete the hose construction 30 by disposing an annular end cuff of polymeric material over the one end 40 of the hose 31 that is illustrated in FIG. 1 to embed the terminal connectors 36 and 37 therein, as well as to provide terminal connectors and an end cuff at the other end (not shown) of the hose 31 in order to complete the hose construction 30 for use with a vacuum cleaner in a conventional manner, only the details of the hose construction 30 that is necessary to understand the features of this invention will now be set forth as the other structure and details of a vacuum cleaner hose construction are conventional in the art as fully set forth in the aforementioned U.S. Pat. No. 3,928,715 to Holden.

In particular, when the hose 31 is initially formed as illustrated in FIG. 2, the end 40 thereof terminates in a cutoff transverse edge 41 thereof and then the end 40 is cut away in the area 42 to define the end portions 34 and 35 of the conductors 32 and 33 so that the terminals 36 and 37 can be attached thereto by cutting through the insulation 38 and 39 and making electrical contact with the conductors 32 and 33 as will be apparent hereinafter.

Because the terminal connectors 36 and 37 are identical except for the length thereof, as is evidenced by FIG. 1, only the terminal connector 36 will now be described with the understanding that such structure applies to the terminal connector 37.

Figure 6:
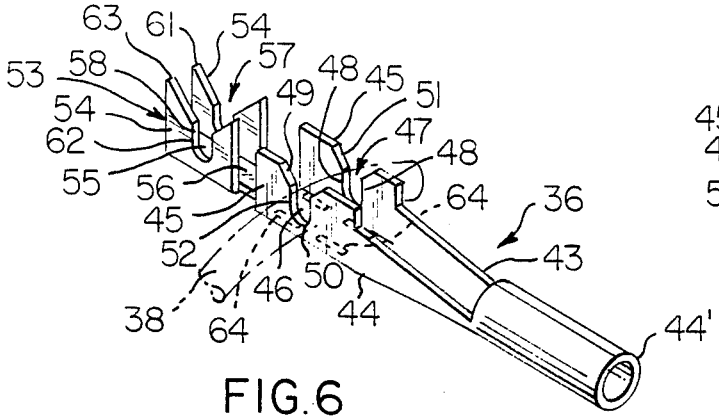
FIG. 6 is a perspective view illustrating one of the terminal connectors of the hose construction of FIG. 1 before the same has been attached to the electrical connector of the vacuum hose.

As illustrated in FIG. 6, the terminal connector 36 is formed from any suitable metallic material and has a body portion 43 provided with opposed ends 44 and 44' with the end 44' being suitably shaped to either comprise a female means or a male means for interconnecting to another electrical conductor in a manner well known in the art. The end 44 of the body portion 43 is defined by a pair of like knife-like portions 45 being disposed and held in spaced apart parallel relation by a substantially flat bridging portion 46 whereby the knife-like portions 45 and bridging portion 46 define a generally U-shaped cross-sectional configuration.

The knife-like portions 45 of the terminal connector 36 each has a slot 47 formed therein and defined by opposed side edges 48. Each slot 47 has an open end 49 and a closed end 50, the open end 49 being defined by the edges 48 diverging away from each other to provide cam surfaces 51 that lead to generally straight and parallel sections 52 of the edges 48 while the closed end 50 of the slot 47 is substantially semi-circular as illustrated. The straight parallel sections 52 of the edges 48 of each knife-like portion 45 are spaced apart a distance that is slightly less than the diameter of its conductor 32 so as to not only cut through the insulation 38 thereon, but also to cut slightly into the metal of the conductor 32 when that end portion 34 is being disposed down into the slots 47 of the knife-like portions 45 of the terminal 36 as illustrated in FIGS. 1 and 4–7. In this manner, the conductor 32 is wedged between the opposed side edges 48 of the knife-like portions 45 to provide an electrical connection between the conductor 32 and the terminal connector 36.

While the knife-like portions 45 of the terminal 36 are shown as being single thickness sections of metal, it is to be understood that the same could be a plurality of sections folded against each other such as is set forth in the aforementioned U.S. Pat. No. 3,928,715 to Holden, and the slots 47 can have other than the generally U-shape thereof, such as by being substantially keyhole-shaped as set forth in the aforementioned U.S. Pat. No. 3,928,715, to Holden, if desired.

While the structure of the terminal connector 36 previously described is substantially the same as the structure of the terminal connector set forth in the aforementioned U.S. Pat. No. 3,928,715 to Holden, the terminal connector 36 of this invention has a unique holding means that is generally indicated by the reference numeral 53 and which is utilized for holding the end portion 34 of the conductor 32 in the slots 47 of the knife-like portion 45 after the end portion 34 has been disposed therein in the manner previously set forth.

Figure 5:
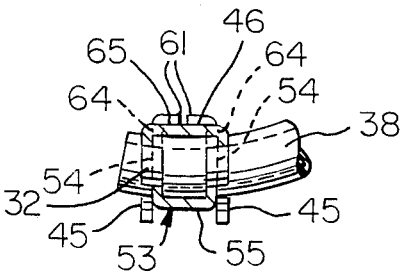
FIG. 5 is a fragmentary cross-sectional view taken on line 5—5 of FIG. 4.

In particular, the holding means 53 comprises a metallic one-piece member having a pair of knife-like portions 54 disposed and held in spaced apart parallel relation by an integral bridging member 55 which is of such a dimension that the knife-like portions 54 are adapted to be disposed between and closely adjacent the knife-like portions 45 in the manner illustrated in FIGS. 1, 5 and 7, the bridging portion 55 having an extension 56 which is integral and one-piece with the previously described bridging member 46 and which originally spaces the knife-like portions 54 from the knife-like portions 45 a distance sufficient to permit the knife-like portions 54 to be inserted as a unit between the knife-like portions 45 by suitably bending the extension 56 as illustrated.

The knife-like portions 54 of the holding means 53 respectively have slot means 57 formed therein which have open ends 59 and closed ends 60 and which are of substantially the same configuration and size as the slot means 47 of the knife-like portions 45 and thereby have opposed side edges 58 with camming portions 61 and substantially straight portions 62.

Figure 7:
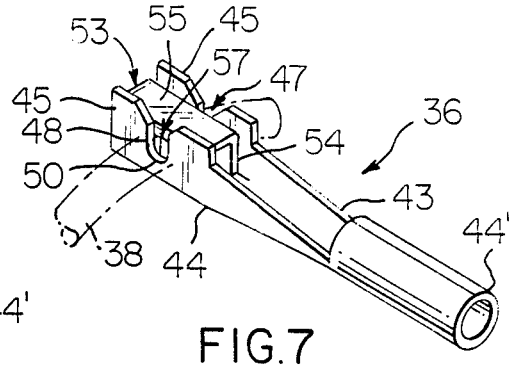
FIG. 7 is a perspective view similar to FIG. 6 and illustrates the final position of the holding means of the terminal connector of FIG. 6 for holding the electrical conductor thereto.

The camming portions 61 of the knife-like portions 54 of the holding means 53 define projections 63 that are adapted to be respectively disposed in cooperating slots 64 formed in the bridging member 46 of the terminal connector 36 when the holding means 53 is folded or rotated into its holding position as illustrated in FIG. 7, such projections 63 passing through the slots 64 and beyond the exterior surface 65 of the bridging member 46 to be subsequently bradded or folded over against the surface 65 in the manner illustrated in FIGS. 4 and 5 to fasten the holding means 53 in its holding position.

Figure 4:
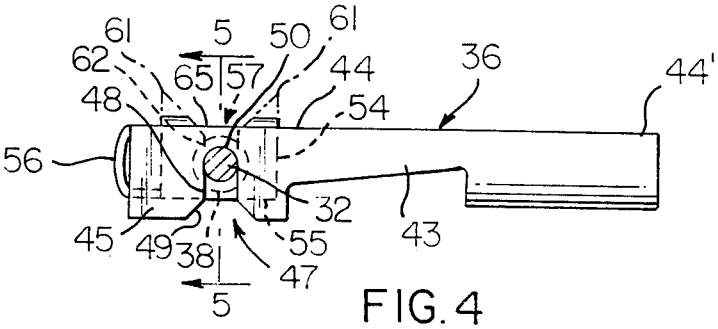
FIG. 4 is an enlarged cross-sectional view taken on line 4—4 of FIG. 1.

When the holding means 53 is disposed in its final holding position as illustrated in FIGS. 4 and 5, it can be seen that the end portion 34 of the conductor 32 also has the insulation 38 thereof cut away by the edges 58 of the knife-like portions 54 as well as have some of the metal of the conductor 32 slightly cut into by the edges 58 of the knife-like portions 54 so that the conductor 32 is wedged between the straight portions 62 of the knife-like portions 54 in the same manner that the conductor 32 is wedged between the straight portions 52 of the knife-like portions 45. In addition, it can be seen that the bottoms 50 and 60 of the knife-like portions 45 and 54 respectively cut into the insulation 38 of the conductor 32 and engage the metal of the conductor 32 on opposite sides thereof so as to limit the amount of insertion of the holding means 53 in between the knife-like portions 45 as illustrated.

Therefore, it can be seen that it is a relatively simple method of this invention to fasten the terminal connector 36 of this invention to the end portion 34 of a conductor 32 by merely inserting that end portion 34 of the conductor 32 into the slots 47 of the knife-like portions 45 as illustrated in FIG. 6 to cut through the insulation 38 and to wedge that conductor 32 between the straight portions 52 of the edges 48 and then fold over the holding means 53 from the position illustrated in FIG. 6 to the position illustrated in FIG. 7 wherein the conductor 32 is, in effect, forced into the slots 57 of the knife-like portions 54 of the holding means 53 to have the straight sections 62 of the edges 58 of the knife-like portions 54 cut through the insulation 38 and wedge against the conductor 32 and have the ends 63 of the knife-like portions 54 pass through the slots 64 in the bridging member 46 to be subsequently bradded or folded over in any suitable manner against the outside surface 65 of the bridging portion 56 to hold the holding means 53 in place.

In this manner, the holding means 53 has a part thereof that comprises the bridging member 55 and the knife-like portions 54 thereof, in effect, disposed adjacent the conductor 32 to hold that conductor 32 in the slots 47 of the knife-like portions 45 of the connector 36 by trapping the conductor 32 between knife-like portions 54 and bridging member 55 of the holding means 53 and the closed ends 50 of the slots 47 as illustrated in FIG. 7.

Conversely, one can consider the unit 53 as being the terminal connector and the body member 43 as being the holding means because the knife-like portions 45 and the bridging member 46 of the body member 43 are disposed adjacent the conductor 32 that is wedged between the edges 58 of the knife-like portions 54 of the unit 53 and trap the conductor 32 between the knife-like portions 45 and bridging member 46 of the body member 43 and the closed ends 60 of the slots 57 of the unit 53. This analogy equally applies to the other embodiments of this invention.

While the slots 57 of the knife-like portions 54 of the holding means 53 have been illustrated and described as having the same configuration as the slots 47 of the knife-like portion 45, it is to be understood that the slots 57 of the knife-like portions 54 of the holding means 53 can have other configurations as desired.

Figure 8:
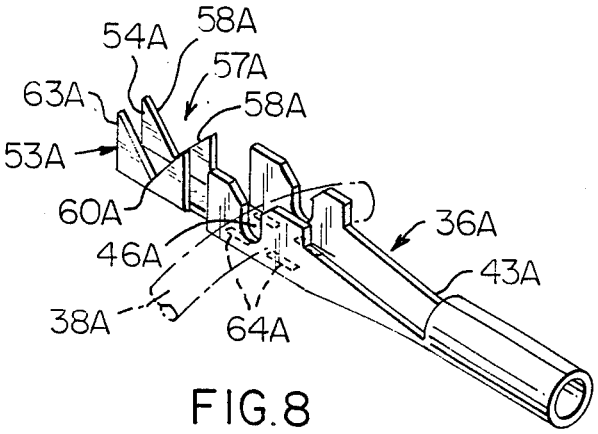
FIG. 8 is a view similar to FIG. 6 and illustrates another embodiment of the terminal connector of this invention.
Figure 9:
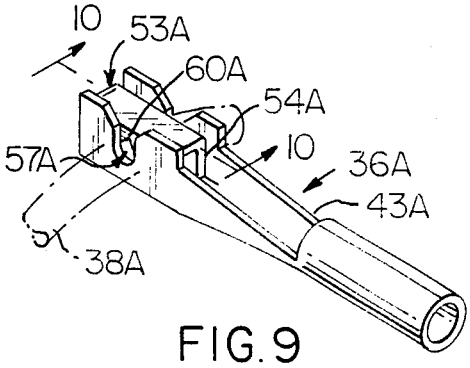
FIG. 9 is a view similar to FIG. 8 and illustrates the holding means of the terminal connector of FIG. 8 in the final position thereof for holding a conductor to the terminal connector of FIG. 8.
Figure 10:
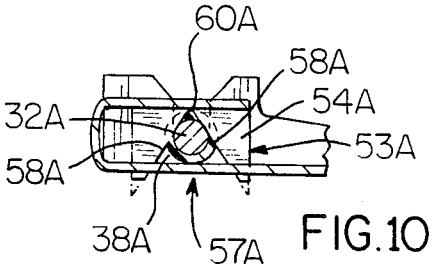
FIG. 10 is a fragmentary cross-sectional view taken on line 10—10 of FIG. 9.

For example, reference is now made to FIGS. 8–10 wherein another terminal connector of this invention is generally indicated by the reference numeral 36A and parts thereof similar to the parts of the terminal connector 36 previously described are indicated by like reference numerals followed by the reference letter "A".

As illustrated in FIGS. 8–10, the knife-like portions 54A of the holding means 53A have the slot means 57A thereof defined by substantially straight opposed edges 58A that define a substantially V-shaped slot 57A having an apex 60A that defines the closed end thereof. However, the straight edges 58A terminate in projection 63A which are adapted to be inserted into the slots 64A in the bridging member 46A of the terminal body 43A in the manner previously set forth to be bradded over to hold the knife-like portions 54A in the final holding position illustrated in FIG. 9, the edges 58A effectively cutting through the insulation 38A and electrically engaging the metal of the conductor 32A when the holding means 53A is disposed in its final holding position.

Also, while the terminal connectors 36 and 36A respectively illustrate the holding means 53 and 53A as being integral and one-piece with a body portion of the respective terminal connector 36 or 36A, it is to be understood that the holding means of the terminal connector of this invention can initially be a part separate therefrom to be subsequently carried by the terminal connector in its holding position.

Figure 11:
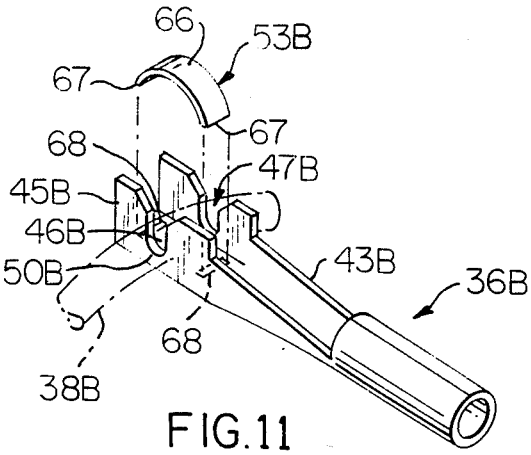
FIG. 11 is a view similar to FIG. 8 and illustrates another embodiment of the terminal connector of this invention, FIG. 11 illustrating the holding means of the terminal connector exploded therefrom.
Figure 13:
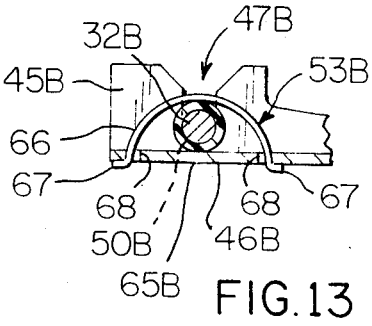
FIG. 13 is a fragmentary cross-sectional view taken on line 13—13 of FIG. 12.
Figure 12:
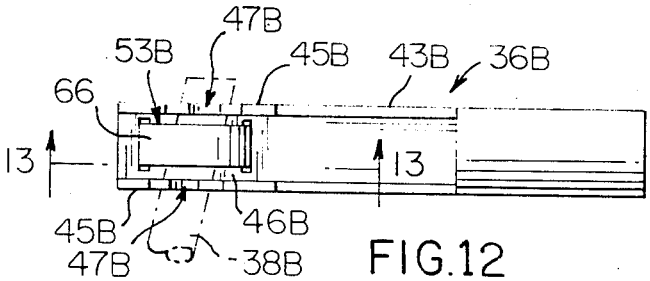
FIG. 12 is a top view of the terminal connector of FIG. 11 after the holding means thereof has been disposed in place for holding an electrical conductor to the terminal connector of FIG. 11.
Figure 14:
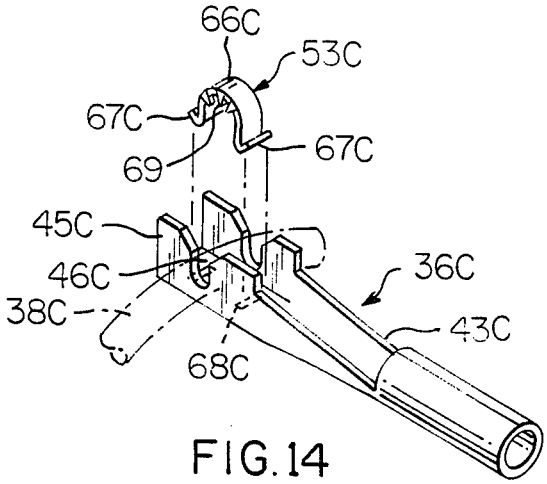
FIG. 14 is a view similar to FIG. 11 and illustrates another embodiment of the terminal connector of this invention.
Figure 15:
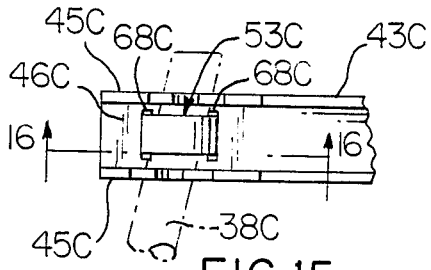
FIG. 15 is a fragmentary top view of the terminal connector of FIG. 14 after the holding means thereof has been disposed in place for holding an electrical conductor to the terminal connector of FIG. 14.
Figure 17:
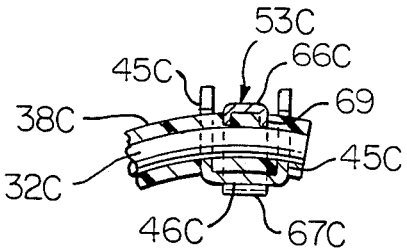
FIG. 17 is a fragmentary cross-sectional view taken on line 17—17 of FIG. 16.

For example, reference is now made to FIGS. 11–13 wherein another terminal connector of this invention is generally indicated by the reference numeral 36B and parts thereof similar to the terminal connectors 36 and 36A previously described are indicated by like reference numerals followed by the reference letter "B".

As illustrated in FIGS. 11–13, the body member 43B of the connector 36B has knife-like portions 45B that are substantially similar to and function in the same manner as the knife-like portions 45 previously described. However, the holding means 53B of the terminal connector 36B comprises an elongated metallic band or strap 66 having opposed ends 67 which are adapted to be respectively received in cooperating slots 68 formed in the bridging member 46B of the knife-like portions 45B after the conductor 32B has been fully received in the slots 47B of the knife-like portions 45B as illustrated in FIGS. 11–13. The ends 67 of the band or strap 66 project sufficiently beyond the exterior surface 65B of the bridging portion 46B so that the same can be bradded or turned over as illustrated in FIG. 13 to hold the holding means 53B between the knife-like portions 45B and trap the conductor 32B between the band 66 and the closed ends 50B of the slots 47B as illustrated in FIG. 13.

Because the band 66 does not cut into the insulation 38B of the end portion 34B, the band 66 can be formed of material other than metallic material, if desired, as the same is not electrically interconnected to the conductor 32B.

While the holding means 53, 53A and 53B of this invention have been respectively described as having the portions 63, 63A and 67 thereof subsequently bradded or otherwise turned over after the same have projected through slots 64, 64A and 68 of the respective body member 43, 43A and 43B, it is to be understood that the holding means 53, 53A and 53B could each be provided with means that snap-fit through such slot means so as to snap-fit the holding means to the body member of the terminal connector.

For example, another terminal connector of this invention is generally indicated by the reference numeral 36C in FIGS. 14–17 and parts thereof similar to the terminal connectors 36, 36A and 36B previously illustrated and described are indicated by like reference numerals followed by the reference letter "C".

Figure 16:
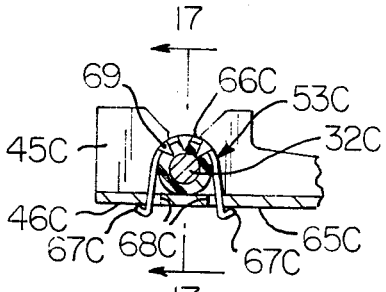
FIG. 16 is a fragmentary cross-sectional view taken on line 16—16 of FIG. 15.

As illustrated in FIGS. 14–17, the body member 43C of the terminal connector 36C has the knife-like portions 45C formed in the same manner as the knife-like portions 45 previously described and the holding means 53C comprises a metallic band means 66C which has the opposed ends 67C thereof preformed to form barb-like members that can snap-fit through the slots 68C in the bridging portion 46C of the knife-like portions 45C and hook against the outer surface 65C thereof as illustrated in FIG. 16 without requiring the user to turn over the ends 67C as previously set forth.

In addition, the band 66C can be provided with suitable barbs 69 which will dig into the insulation 38C of the end portion 34C of the conductor 32C to electrically engage into the metal of the conductor 32C to electrically interconnect the holding means 53C to the conductor 32C.

While the bands 66 and 66C of the terminal connectors 36B and 36C of this invention have been illustrated and described as being parts separate from respective body member 43B and 43C of the terminal connectors 36B and 36C, it is to be understood that such band means can be integral therewith if desired.

Figure 18:
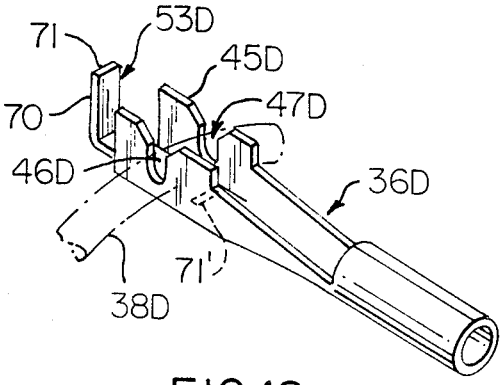
FIG. 18 is a view similar to FIG. 14 and illustrates another embodiment of the terminal connector of this invention.
Figure 19:
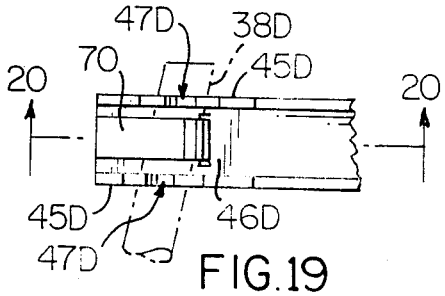
FIG. 19 is a fragmentary top view of the terminal connector of FIG. 18 with the holding means thereof disposed in place for holding an electrical conductor to the terminal connector of FIG. 18.
Figure 20:
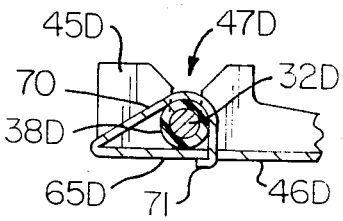
FIG. 20 is a fragmentary cross-sectional view taken on line 20—20 of FIG. 12.

For example, another terminal connector of this invention is generally indicated by the reference numeral 36D in FIGS. 18–20 and parts thereof that are similar to the terminal connectors 36, 36A, 36B and 36C are indicated by like reference numerals followed by the reference letter "D".

As illustrated in FIGS. 18–20, the terminal connector 36D has the holding means 53D thereof formed by a band-like extension 70 of the bridging portion 46D of the knife-like portions 45D with the extension 70 having a free end 71 which is adapted to subsequently project into a suitable slot 71' formed through the bridging portion 46D after the band 70 has been disposed over the end portion 34D of the conductor 32D that has been previously disposed in the slots 47D of the knife-like portions 45D. In this manner, the end 71 of the band 70 can be subsequently turned over or bradded against the exterior surface 65D of the bridging member 46D in the manner illustrated in FIG. 20 to hold the band 70 in its holding position as illustrated in FIGS. 19 and 20. Of course, the end 71 of the band 70 could be provided with snap-fit means in the same manner as the ends 67C of the band 66C previously described in order to snap-fit the holding means 53D in its final position and the band 70 could be provided with projections to cut into the insulation 38D on the conductor 32D to electrically interconnect the band 70 to the conductor 32D in the same manner previously described.

While the holding means 53, 53A, 53B, 53C and 53D of the terminal connectors 36, 36A, 36B, 36C and 36D have each held a conductor in wedging relation in the slots of the knife-like portions of the body member of the respective terminal connector, it is to be understood that the slots in the knife-like portions of the body member of the terminal connector need not be insulation piercing or cutting slots and that the holding means itself can comprise the sole means for cutting through the insulation of the conductor so as to provide the electrical interconnection between the terminal connector and the conductor.

Figure 21:
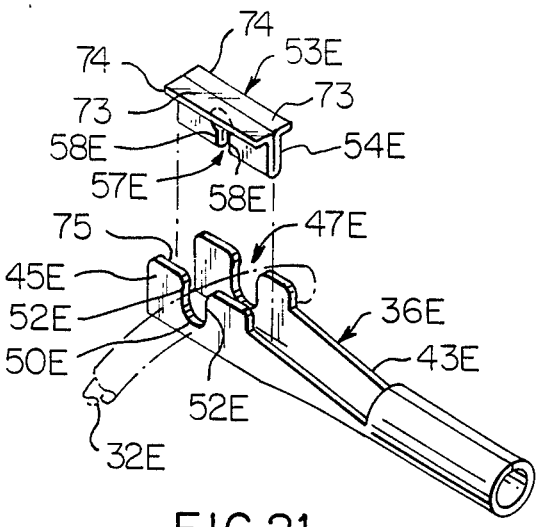
FIG. 21 is a view similar to FIG. 18 and illustrates another embodiment of the terminal connector of this invention with the holding means thereof being illustrated as being exploded therefrom.
Figure 22:
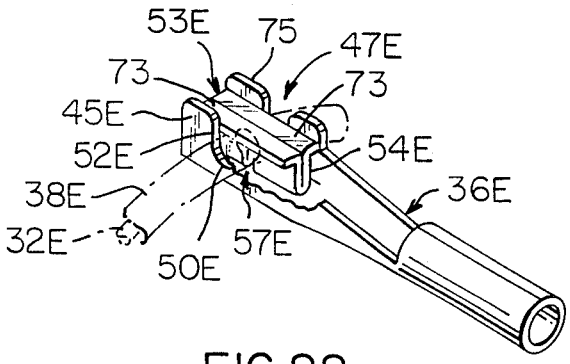
FIG. 22 is a view similar to FIG. 21 and illustrates the holding means inserted into the terminal connector.
Figure 23:
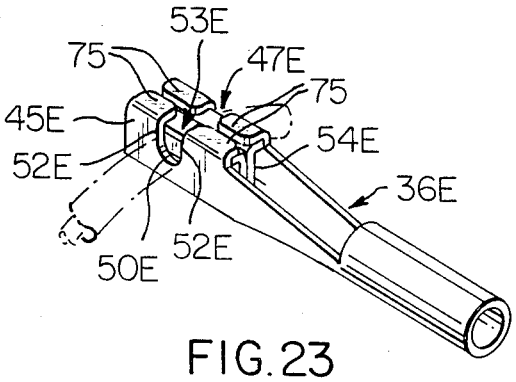
FIG. 23 is a view similar to FIG. 22 and illustrates the holding means held in place by the folded over tabs of the terminal connector.

For example, another terminal connector of this invention is generally indicated by the reference numeral 36E in FIGS. 21–23 and parts thereof that are similar to the terminal connectors 36–36D are indicated by like reference numerals followed by the reference letter "E".

As illustrated in FIG. 21, the knife-like portions 45E of the body member 43 of the terminal connector 36E each has the slot 47E thereof formed of such a width that the adjacent straight portions 52E thereof do not cut into the insulation 38E of the conductor 32E when the end portion 34E thereof is inserted into the slots 47E and bottoms out against the bottoms 50E thereof.

However, the holding means 53E of the terminal connector 36E comprises a metallic part folded upon itself to define a knife-like portion 54E having an insulating cutting slot 57E therein and having two outwardly directed tabs 73 disposed in side-by-side substantially coplanar relation at the top thereof and having a width between the outer side edges 74 thereof that will just fit in between the adjacent knife-like portions 45E of the body member 43E when the holding means 53E is inserted therebetween in the manner illustrated in FIG. 22, the slots 57E of the holding means 53E cutting into the insulation 38E of the conductor 32E and wedging the metallic part of the conductor 32E between the opposed side edges 58E of the slot 57E to electrically interconnect the same together.

Thereafter, the upper parts 75 of the knife-like portions 45E of the body member 43E are folded over the tabs 73 of the holding means 53E in the manner illustrated in FIG. 23 to hold the holding means 53 in its fully inserted relation between the knife-like portions 45E.

While the slots 47E of the knife-like portions 45E of the body member 43E have been illustrated and described as being non-insulation cutting slots 47E, the same could also be insulation cutting slots 47E in any of the manners previously set forth if desired.

Therefore, it can be seen that this invention not only provides a new vacuum cleaner hose construction and a new method of making a vacuum cleaner hose construction, but also this invention provides a new terminal connector and a new method of making a terminal connector.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a vacuum cleaner hose construction that comprises an elongated vacuum hose having an electrical conductor extending therealong and being provided with an end portion, and an electrical connector carried by said hose and being fixed to said end portion, said connector having a knife-like portion provided with opposed edges defining sides of a slot therein that has an open end and a closed end, said end portion being disposed in said slot of said connector and being wedged between said opposed edges thereof for providing electrical connection therebetween, said connector having another knife-like portion disposed in spaced parallel relation to the first-named knife-like portion and being fixed to said end portion of said conductor by said slot thereof that faces in the same direction that said slot of said first-named knife-like portion faces, the improvement wherein said connector has holding means carried thereby and having a part thereof disposed adjacent said conductor to hold said conductor in said slots by trapping said conductor between said part and said closed ends of said slots, said holding means being disposed intermediate said knife-like portions, said connector having two snap-fit means disposed on opposite sides of said slots, said holding means having two snap-fit means respectively snap-fitted with said snap-fit means of said connector whereby said holding means is carried by said connector intermediate said knife-like portions thereof.

2. A vacuum cleaner hose construction as set forth in claim 1 wherein said holding means initially was separate from said connector.

3. A vacuum cleaner hose construction as set forth in claim 1 wherein said hose has a plurality of said electrical conductors extending therealong with each being provided with said end portion and wherein said construction has a plurality of said connectors respectively fixed to said end portions in a like manner.

* * * * *